US012765589B2

(12) United States Patent
Lynch et al.

(10) Patent No.: US 12,765,589 B2
(45) Date of Patent: Oct. 20, 2026

(54) TRAY WITH PIERCING ELEMENT FOR USE WITH SHISHA DEVICE

(71) Applicant: PHILIP MORRIS PRODUCTS S.A., Neuchâtel (CH)

(72) Inventors: James Lynch, Dublin (IE); Thomas Salvador, Tiefenbach (DE)

(73) Assignee: Philip Morris Products S.A., Neuchâtel (CH)

( * ) Notice: Subject to any disclaimer, the term of this patent is extended or adjusted under 35 U.S.C. 154(b) by 661 days.

(21) Appl. No.: 17/781,855

(22) PCT Filed: Dec. 2, 2020

(86) PCT No.: PCT/IB2020/061389
§ 371 (c)(1),
(2) Date: Jun. 2, 2022

(87) PCT Pub. No.: WO2021/111334
PCT Pub. Date: Jun. 10, 2021

(65) Prior Publication Data

US 2023/0000147 A1 Jan. 5, 2023

(30) Foreign Application Priority Data

Dec. 2, 2019 (EP) ..... 19213022

(51) Int. Cl.
*A24F 1/30* (2006.01)
*A24B 15/167* (2020.01)

(52) U.S. Cl.
CPC ..... *A24F 1/30* (2013.01); *A24B 15/167* (2016.11)

(58) Field of Classification Search
None
See application file for complete search history.

(56) References Cited

U.S. PATENT DOCUMENTS

| | | | | |
|---|---|---|---|---|
| 9,578,984 | B2 | 2/2017 | Heijdel et al. | |
| 10,561,172 | B2 | 2/2020 | Armoush et al. | |
| 2006/0086365 | A1* | 4/2006 | Liu | A24F 1/30 131/173 |
| 2008/0060663 | A1* | 3/2008 | Hamade | A24B 13/00 131/178 |

(Continued)

FOREIGN PATENT DOCUMENTS

| | | |
|---|---|---|
| DE | 102018111599 | 11/2019 |
| EP | 2890255 | 7/2015 |

(Continued)

OTHER PUBLICATIONS

International Preliminary Report on Patentability for PCT/IB2020/061389, issued Jun. 16, 2022; 7 pages.

(Continued)

*Primary Examiner* — Philip Y Louie
*Assistant Examiner* — John Mitchell Martin
(74) *Attorney, Agent, or Firm* — Mueting Raasch Group

(57) ABSTRACT

A tray for use with a shisha device includes a cavity for receiving a cartridge comprising aerosol-forming substrate. The tray is configured to form openings in the cartridge when the cartridge is inserted into the cavity. The openings formed in the cartridge allow air flow through the cartridge when cartridge and tray are received by the shisha device.

20 Claims, 5 Drawing Sheets

(56) References Cited

U.S. PATENT DOCUMENTS

| | | | | |
|---|---|---|---|---|
| 2016/0029696 | A1* | 2/2016 | Obeidallah | A24F 1/30 392/386 |
| 2017/0172203 | A1* | 6/2017 | Gebara | A24D 1/14 |
| 2017/0251718 | A1* | 9/2017 | Armoush | A24F 40/40 |
| 2017/0265521 | A1* | 9/2017 | Do | A24F 1/30 |

FOREIGN PATENT DOCUMENTS

| | | |
|---|---|---|
| WO | 20170080545 | 5/2017 |
| WO | 20170178931 | 10/2017 |
| WO | 20190215348 | 11/2019 |

OTHER PUBLICATIONS

Extended EP Search for EP 19213022.7 issued by the European Patent Office, Jan. 23, 2020; 7 pgs.

International Search Report and Written Opinion for PCT/IB2020/061389, issued by the European Patent Office, Mar. 12, 2021; 12 pgs.

* cited by examiner

TRAY WITH PIERCING ELEMENT FOR USE WITH SHISHA DEVICE

This application is the § 371 U.S. National Stage of International Application No. PCT/IB2020/061389, filed 2 Dec. 2020, which claims the benefit of European Application No. 19213022.7, filed 2 Dec. 2019.

This disclosure relates to aerosol-generating devices and to cartridges containing an aerosol-forming substrate for use in aerosol-generating devices; and more particularly, to aerosol-generating devices having a tray for holding a cartridge containing an aerosol-forming substrate.

Traditional shisha devices are used to smoke tobacco and are configured such that vapor and smoke pass through a water basin before inhalation by a consumer. Shisha devices may include one outlet, or more than one outlet so that the device may be used by more than one consumer at a time. Use of shisha devices is considered by some to be a leisure activity and a social experience.

Typically, traditional shishas are used in combination with a substrate, sometimes referred to in the art as hookah tobacco, tobacco molasses, or simply as molasses. Traditional shisha substrates are relatively high in sugar (in some cases, up to ~50% vs. the ~20% typically found in conventional tobacco substrates, such as in combustible cigarettes). The tobacco used in shisha devices may be mixed with other ingredients to, for example, increase the volume of the vapor and smoke produced, to alter flavor, or both.

Traditional shisha devices employ charcoal, such as charcoal pellets to heat and sometimes combust the tobacco substrate to generate an aerosol for inhalation by a user. Using charcoal to heat the tobacco may cause full or partial combustion of the tobacco or other ingredients. Additionally, charcoal may generate harmful or potentially harmful products, such as carbon monoxide, which may mix with the shisha vapor and pass through the water basin to the outlet.

One way to reduce the production of carbon monoxide and combustion by-products is to employ e-liquids rather than tobacco. Shisha devices that employ e-liquids eliminate combustion by-products but deprive shisha consumers of the traditional tobacco-based experience.

Other shisha devices have been proposed that employ electric heaters to heat, but not combust, tobacco. Such electrically heated heat-not-burn shisha devices heat the tobacco substrate to a temperature sufficient to produce an aerosol from the substrate without combusting the substrate, and therefore reduce or eliminate by-products associated with combustion of tobacco.

Shisha devices may employ a cartridge for housing an aerosol-forming substrate. The cartridge may be filled with such aerosol-forming substrate. The aerosol-forming substrate may comprise tobacco, preferably shisha substrate, such as molasses—a mixture of tobacco, water, sugar, and other components, such as glycerine, flavors, etc. The heating system of the electrically heated shisha device heats the contents of the cartridge to generate aerosol, which is conveyed through an airflow path to a user.

In order to facilitate airflow through the cartridge and the flow of the aerosol from the cartridge, a shisha cartridge may have one or more holes through one or more walls. The cartridge may include one or more holes at the top, one or more holes at the bottom, or both one or more holes at the top and one or more holes at the bottom. Alternatively, the top may be open, that is, the top wall may be partially or completely absent. Any holes or openings in the top and bottom walls may be closed by a removable (for example, peelable) sealing layer, such as a film, sticker, or liner, during storage. The removable layer may protect the contents (for example, the molasses) from exposure to air and oxygen. The removable layer may be removed (for example, pulled or peeled off) by a user prior to first use of the cartridge.

The holes or openings in the cartridge, if left unsealed, may lead to loss of freshness (for example, moisture content) or contamination of the substrate, as well as issues with leakage. For one or more reasons, such as in order to maintain freshness, to prevent leakage of the substrate, or to preserve the quality and integrity of the substrate during storage, it is desirable to close or seal the openings or holes of the cartridge prior to use or between uses if the entire contents of the cartridge are not used at once.

However, having a user peel or remove seal to expose the openings in the cartridge may result in some of the contents spilling or leaking onto a user's hands. The user may also have contents of the cartridge spill or leak on their hands when removing a used cartridge from the shisha device. In addition, the cartridge may be hot when removed from the shisha device, which may cause some discomfort for a user grasping the cartridge for removal.

Various embodiments of the present disclosure relate to a tray for use with a shisha device and a shisha device or cartridge including such a tray. The cartridge may be placed in the tray, and the user may handle the tray rather than the cartridge for one or more steps associated with use of the cartridge with the shisha device. For example, the tray may be used to place the cartridge in the shisha device, may be used to remove the cartridge from the shisha device, or may be used to place the cartridge in the shisha device and to remove the cartridge from the shisha device. Preferably, the cartridge may be used with the shisha device while the cartridge is received in the tray. That is, the shisha device may preferably be operated to generate aerosol from the aerosol-forming substrate of the cartridge for delivery to a user when the tray with the received cartridge are inserted into a shisha device.

The tray may be configured to pierce the cartridge to introduce openings for airflow through the cartridge when the cartridge is used with the shisha device. Accordingly, the user may avoid direct contact with the cartridge when the cartridge is pierced by the tray. Preferably, the cartridge does not include preformed openings covered by a removable seal so that the user may avoid accidental contact with cartridge contents when removing the seal. Rather, the tray may be used to pierce the cartridge to form one or more openings. In addition to preventing accidental contact of the cartridge contents with the user's hands, cartridges without preformed holes tend to have an advantage of longer shelf life relative to cartridges that have preformed holes, even if covered by a removable seal.

The tray may comprise one or more features or elements that aid in proper insertion of cartridge into shisha device, which may provide for a more reliable experience for the user.

The tray may prevent users from directly contacting a hot surface of shisha device or cartridge after heating by the shisha device, which may decrease the change of discomfort due to direct contact with the hot surface. The tray may facilitate disposal of the cartridges after use in the shisha device.

According to another embodiment, a tray for use with a shisha device may comprise a body defining a cavity for receiving a cartridge containing an aerosol forming substrate. The cavity may have an open top end into which the cartridge is insertable and may have a bottom end. The tray may include a piercing element extending into the cavity from the bottom end of the cavity. The piercing element may be positioned to pierce the cartridge at a first surface when the cartridge is inserted into the cavity of the tray and force is applied to the cartridge to cause the first surface of the cartridge to move towards the bottom end of the cavity.

The body of the tray may comprise a sidewall that forms an interior surface of the cavity. The sidewall may be formed from a thermally conductive material. The thermally conductive material may transfer heat from a heating element of the shisha device to the cartridge to heat the aerosol-forming substrate in the cartridge to volatilize one or more constituents of the substrate for delivery in an aerosol to a user.

At least a portion of the sidewall may taper inwardly in a direction from the open top end of the cavity to the bottom end of the cavity. Such a shape may aid in positioning a similarly shaped cartridge within the cavity. For example, the cartridge may be readily inserted until the bottom portion of cartridge has a section of the tapered sidewall. For example, the cartridge may be frustoconical, and the sidewall may be configured to contact the cartridge along a length of the cartridge.

The tray may comprise a handle extending from the body away from the cavity. The handle may allow the user to manipulate the cartridge without touching the cartridge during the manipulation.

The handle may comprise a thermally insulating material. Thermal insulation may allow the user to grasp the handle without experiencing discomfort that may be associated with grasping a hot cartridge removed from the shisha device soon after the cartridge has been heated by the device.

The tray may comprise a sidewall that forms an interior surface of the cavity and may comprise an exterior wall. A second cavity may be formed between the exterior wall and the sidewall that forms the interior surface of the cavity. The second cavity may be configured to receive a portion of the shisha device. That is, the tray may be disposed about a portion of the shisha device such that the portion of the shisha device is received in the second cavity between the exterior wall and the sidewall that forms the interior surface of the cavity. The exterior wall may be thermally insulated from the sidewall. Thus, heat from a heating element of the shisha may be preferentially transferred through the sidewall of the tray to the cartridge rather than through the exterior wall of the tray.

The tray may comprise a cap for covering the open top end of the cavity. The cap may comprise a cap piercing element extending from a surface configured to face the cavity when the cap covers the open top end of the cavity. The piercing element of the cap may extend into the cavity and may be positioned to pierce the cartridge at a second surface when the cartridge is inserted in the cavity of the tray and force is applied to the cap to cause the cap piercing element to move towards the bottom end of the cavity.

According to another embodiment, a tray for use with a shisha device comprises a body defining a cavity for receiving a cartridge containing an aerosol forming substrate. The cavity has an open top end into which the cartridge is insertable and has a bottom end. The tray includes a piercing element extending into the cavity from the bottom end of the cavity. The piercing element is positioned to pierce the cartridge at a first surface when the cartridge is inserted into the cavity of the tray and force is applied to the cartridge to cause the first surface of the cartridge to move towards the bottom end of the cavity.

The body of the tray may comprise a sidewall that forms an interior surface of the cavity. The sidewall may be formed from a thermally conductive material. At least a portion of the sidewall may taper inwardly in a direction from the open top end of the cavity to the bottom end of the cavity. The tray may comprise a handle extending from the body away from the cavity. The handle may comprise a thermally insulating material. The tray may comprise a sidewall that forms an interior surface of the cavity and may comprise an exterior wall. A second cavity may be formed between the exterior wall and the sidewall that forms the interior surface of the cavity. The second cavity may be configured to receive a portion of the shisha device. The tray may comprise a cap for covering the open top end of the cavity. The cap may comprise a cap piercing element. The cap piercing element may extend from a surface configured to face the cavity when the cap covers the open top end of the cavity. The piercing element may extend into the cavity and may be positioned to pierce the cartridge at a second surface when the cartridge is inserted in the cavity of the tray and force is applied to the cap to cause the cap piercing element to move towards the bottom end of the cavity.

The terms used in the present disclosure will have their generally accepted definitions unless otherwise defined herein.

The term "aerosol" is used herein to refer to a suspension of solid particles or liquid droplets, or a combination of solid particles and liquid droplets in a gas. The gas may be air. The solid particles or liquid droplets may comprise one or more volatile flavor compounds. Aerosol may be visible or invisible. Aerosol may include vapors of substances that are ordinarily liquid or solid at room temperature. Aerosol may include vapors of substances that are ordinarily liquid or solid at room temperature, in combination with solid particles or in combination with liquid droplets or in combination with both solid particles and liquid droplets. In some embodiments, the aerosol comprises nicotine.

The term "aerosol-forming substrate" is used herein to refer to a material capable of releasing one or more volatile compounds that can form an aerosol. In some embodiments, an aerosol-forming substrate may be heated to volatilize one or more components of the aerosol-forming substrate to form an aerosol. As an alternative to heating or combustion, in some cases, volatile compounds may be released by a chemical reaction or by a mechanical stimulus, such as ultrasound. The aerosol-forming substrate may be disposed inside the cartridge. Aerosol-forming substrate may be solid or liquid or may comprise both solid and liquid components. Aerosol-forming substrate may be adsorbed, coated, impregnated or otherwise loaded onto a carrier or support. Aerosol-forming substrate may comprise nicotine. Aerosol-forming substrate may comprise plant-based material. Aerosol-forming substrate may comprise tobacco. Aerosol-forming substrate may comprise a tobacco-containing material containing volatile tobacco flavour compounds, which are released from the aerosol-forming substrate upon heating. Aerosol-forming substrate may alternatively comprise a non-tobacco-containing material. Aerosol-forming substrate may comprise homogenised plant-based material. Aerosol-forming substrate may comprise homogenised tobacco material. Aerosol-forming substrate may comprise at least one aerosol-former. Aerosol-forming substrate may comprise other additives and ingredients, such as flavourants.

The terms "integral" and "integrally formed" are used herein to describe elements that are formed in one piece (a single, unitary piece). Integral or integrally formed components may be configured such that they cannot be separable removed from each other without causing structural damage to the piece.

As used herein, the singular forms "a," "an," and "the" also encompass embodiments having plural referents, unless the content clearly dictates otherwise.

As used herein, "or" is generally employed in its sense including "one or the other or both" unless the content clearly dictates otherwise.

The term "about" is used herein in conjunction with numeric values to include normal variations in measurements as expected by persons skilled in the art and is understood to have the same meaning as "approximately." The term "about" is understood to cover a typical margin of error. A typical margin of error may be, for example, ±5% of the stated value.

As used herein, "have," "having," "include," "including," "comprise," "comprising" or the like are used in their open-ended sense, and generally mean "including, but not limited to". It will be understood that "consisting essentially of," "consisting of," and the like are subsumed in "comprising," and the like.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful and is not intended to exclude other embodiments from the scope of the disclosure, including the claims.

The term "substantially" modifies the term that follows by at least about 90%, at least about 95%, or at least about 98%. The term "not substantially" as used herein has the inverse meaning of "substantially," i.e., modifying the term that follows by not more than 10%, not more than 5%, or not more than 2%.

Any direction referred to herein, such as "top," "bottom," "left," "right," "upper," "lower," and other directions or orientations are described herein for clarity and brevity but are not intended to be limiting of an actual device or system. Devices and systems described herein may be used in a number of directions and orientations.

Any suitable shisha cartridge may be used with a tray as described in the present disclosure. The cartridge may comprise a body defining a cavity. Aerosol-forming substrate may be disposed in the cavity of the cartridge. The body is preferably formed from one or more heat resistant materials, such as a heat resistant metal or polymer. The body may comprise a thermally conductive material. For example, the body may comprise any of aluminum, copper, zinc, nickel, silver, any alloys thereof, and combinations thereof. Preferably, the body comprises aluminum.

The cartridge may be of any suitable shape. For example, the cartridge may have a shape configured to be received by a tray. The cartridge may have a substantially cuboidal shape, cylindrical shape, frustoconical shape, or any other suitable shape. Preferably, the cartridge has a generally cylindrical shape or a frustoconical shape.

The shisha device is configured to heat the aerosol-forming substrate in the cartridge. Preferably, the shisha device is configured to heat the aerosol-forming substrate in the cartridge while the cartridge is disposed in the tray. The shisha device may be configured to heat the aerosol-forming substrate in the cartridge by conduction. The cartridge and tray are preferably shaped and sized to allow contact with, or minimize distance from, a heating element of the shisha device. Advantageously, this provides efficient heat transfer from the heating element to the aerosol-forming substrate in the cartridge. The heat may be generated by any suitable mechanism, such as by resistive heating or by induction. To facilitate inductive heating, the cartridge may be provided with a susceptor. For example, the cartridge body may be made from or include a material (for example, aluminum) that is capable of acting as a susceptor, or a susceptor material may be provided within the cavity of the cartridge. A susceptor material may be provided within the cavity of the cartridge in any form, for example a powder, a solid block, shreds, etc. In addition, or alternatively, the tray may comprise a susceptor material.

Any suitable aerosol-forming substrate may be provided in the cavity defined by the body of the cartridge. The aerosol-forming substrate is preferably a substrate capable of releasing volatile compounds. The aerosol-forming substrate is preferably a substrate capable of releasing compounds that may form an aerosol. The volatile compounds may be released by heating the aerosol-forming substrate. The volatile compounds may be released by a chemical reaction or by a mechanical stimulus, such as ultrasound. Aerosol-forming substrate may be solid or liquid or may comprise both solid and liquid components. Aerosol-forming substrate may be adsorbed, coated, impregnated or otherwise loaded onto a carrier or support.

The aerosol-forming substrate may comprise nicotine. The nicotine containing aerosol-forming substrate may comprise a nicotine salt matrix. The aerosol-forming substrate may comprise plant-based material. The aerosol-forming substrate preferably comprises tobacco. The tobacco containing material preferably comprises volatile tobacco flavor compounds, which are released from the aerosol-forming substrate upon heating. The aerosol-forming substrate may comprise homogenized tobacco material. Homogenized tobacco material may be formed by agglomerating particulate tobacco. The aerosol-forming substrate may alternatively or additionally comprise a non-tobacco-containing material. The aerosol-forming substrate may comprise homogenized plant-based material. Aerosol-forming substrate may comprise at least one aerosol-former. Aerosol-forming substrate may comprise other additives and ingredients, such as flavorants. Preferably, the aerosol-forming substrate is a shisha substrate. A shisha substrate is understood to mean a consumable material that is suitable for use in a shisha device. Shisha substrate may include molasses.

The aerosol-forming substrate may include, for example, one or more of: powder, granules, pellets, shreds, spaghettis, strips, or sheets. The aerosol-forming substrate may contain one or more of: herb leaf, tobacco leaf, fragments of tobacco ribs, reconstituted tobacco, homogenized tobacco, extruded tobacco, and expanded tobacco.

The aerosol-forming substrate may include at least one aerosol former. Suitable aerosol formers include compounds or mixtures of compounds which, in use, facilitate formation of a dense and stable aerosol and which are substantially resistant to thermal degradation at the operating temperature of the shisha device. Suitable aerosol formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Particularly preferred aerosol formers are polyhydric alcohols or mixtures thereof, such as triethylene glycol, 1,3-butanediol and, most preferred, glycerine. The aerosol-forming substrate may include any suitable amount of an aerosol former. For example, the aerosol former content of the substrate may be equal to or greater than 5% on a dry weight basis, and preferably greater than 30% by weight on a dry weight basis.

The aerosol former content may be less than about 95% on a dry weight basis. Preferably, the aerosol former content is up to about 55%.

The aerosol-forming substrate preferably includes nicotine and at least one aerosol former. In some embodiments, the aerosol former is glycerine or a mixture of glycerine and one or more other suitable aerosol formers, such as those listed above.

The aerosol-forming substrate may include other additives and ingredients, such as flavorants, sweeteners, etc. In some examples, the aerosol-forming substrate includes one or more sugars in any suitable amount. Preferably, the aerosol-forming substrate includes invert sugar. Invert sugar is a mixture of glucose and fructose obtained by splitting sucrose. Preferably, the aerosol-forming substrate includes from about 1% to about 40% sugar, such as invert sugar, by weight. In some example, one or more sugars may be mixed with a suitable carrier such as cornstarch or maltodextrin.

In some examples, the aerosol-forming substrate includes one or more sensory-enhancing agents. Suitable sensory-enhancing agents include flavorants and sensation agents, such as cooling agents. Suitable flavorants include natural or synthetic menthol, peppermint, spearmint, coffee, tea, spices (such as cinnamon, clove, ginger, or combination thereof), cocoa, vanilla, fruit flavors, chocolate, *eucalyptus*, geranium, eugenol, agave, juniper, anethole, linalool, and any combination thereof.

In some examples, the aerosol-forming substrate is in the form of a suspension. For example, the aerosol-forming substrate may include molasses. As used herein, "molasses" means an aerosol-forming substrate composition comprising about 20% or more sugar. For example, the molasses may include at least about 25% by weight sugar, such as at least about 35% by weight sugar. Typically, the molasses will contain less than about 60% by weight sugar, such as less than about 50% by weight sugar.

Any suitable amount of aerosol-forming substrate (for example, molasses or tobacco substrate) may be disposed in the cavity. In some preferred embodiments, about 3 g to about 25 g of the aerosol-forming substrate is disposed in the cavity. The cartridge may include at least 6 g, at least 7 g, at least 8 g, or at least 9 g of aerosol-forming substrate. The cartridge may include up to 15 g, up to 12 g; up to 11 g, or up to 10 g of aerosol-forming substrate. Preferably, from about 7 g to about 13 g of aerosol-forming substrate is disposed in the cavity.

The aerosol-forming substrate may be provided on or embedded in a thermally stable carrier. The term "thermally stable" is used herein to indicate a material that does not substantially degrade at temperatures to which the substrate is typically heated (e.g., about 150° C. to about 300° C.). The carrier may comprise a thin layer on which the substrate deposited on a first major surface, on second major outer surface, or on both the first and second major surfaces. The carrier may be formed of, for example, a paper, or paper-like material, a non-woven carbon fiber mat, a low mass open mesh metallic screen, or a perforated metallic foil or any other thermally stable polymer matrix. Alternatively, the carrier may take the form of powder, granules, pellets, shreds, spaghettis, strips or sheets. The carrier may be a non-woven fabric or fiber bundle into which tobacco components have been incorporated. The non-woven fabric or fiber bundle may comprise, for example, carbon fibers, natural cellulose fibers, or cellulose-derivative fibers.

The body of the cartridge may include one or more walls. In some embodiments, the body includes a top wall, a bottom wall, and a sidewall. The sidewall may be cylindrical or frustoconical, extending from the bottom to the top. The body may include one or more parts. For example, the sidewall and the bottom wall may be an integral single part. The sidewall and the bottom wall may be two parts configured to engage one another in any suitable manner. For example, the sidewall and the bottom wall may be configured to engage one another by threaded engagement or interference fit. The sidewall and the bottom wall may be two parts joined together. For example, the sidewall and the bottom wall may be joined together by welding or by an adhesive. The top wall and sidewall may be a single integral part. The sidewall and the top wall may be two parts configured to engage one another in any suitable manner. For example, sidewall and the top wall may be configured to engage one another by threaded engagement or interference fit. The sidewall and the top wall may be two parts joined together. For example, the sidewall and the top wall may be joined together by welding or by an adhesive. The top wall, sidewall and bottom wall may all be a single integral part. The top wall, the sidewall, and the bottom wall may be three separate parts configured to engage one another in any suitable manner. For example, the top wall, the sidewall, and the bottom wall may be configured to engage by threaded engagement interference fit, welding, or an adhesive.

One or more walls of the body may form a heatable wall or surface. As used herein, "heatable wall" and "heatable surface" mean an area of a wall or a surface to which heat may be applied, either directly or indirectly. The heatable wall or surface may function as a heat transfer surface through which heat may be transferred from outside of the body to the cavity or to an internal surface of the cavity.

Preferably, the body of the cartridge has a length (for example, an axial length along a vertical center axis) of about 15 cm or less. In some embodiments, the body has a length of about 10 cm or less. The body may have an inside diameter of about 1 cm or more. The inside diameter of the body may be about 1.75 cm or more. The cartridge may have a heatable surface area in the cavity from about 25 $cm^2$ to about 100 $cm^2$, such as from about 70 $cm^2$ to about 100 $cm^2$. The volume of the cavity may be from about 10 $cm^3$ to about 50 $cm^3$; preferably from about 25 $cm^3$ to about 40 $cm^3$. In some embodiments, the body has a length in a range from about 3.5 cm to about 7 cm. The inside diameter of the body may be from about 1.5 cm to about 4 cm. The body may have a heatable surface area in the cavity from about 30 $cm^2$ to about 100 $cm^2$, such as from about 70 $cm^2$ to about 100 $cm^2$. The volume of the cavity may be from about 10 $cm^3$ to about 50 $cm^3$; preferably from about 25 $cm^3$ to about 40 $cm^3$. Preferably, the body is cylindrical or frustoconical.

The cartridge body may include one or more openings or ventilation holes through one or more walls of the body. The ventilation holes may be inlets, outlets, or both. The ventilation holes may be disposed at the bottom wall, top wall, sides, or a combination thereof, of the cartridge. Preferably, the cartridge body does not include any openings or ventilation holes prior to being placed in the tray. Preferably, the tray is configured to pierce the cartridge to form the one or more openings or ventilation holes in the cartridge.

The cartridge body may comprise one or more openings or ventilation holes prior to being pierced by the piercing element of the shisha device. After being pierced by the piercing elements, the cartridge may comprise one or more additional openings.

Following piercing of the cartridge, the cartridge may include one or more inlets and one or more outlets to allow air to flow through the aerosol-forming substrate when the cartridge is used with a shisha device. In some embodiments, the top wall of the cartridge may be absent or may define one or more openings to form the one or more inlets of the cartridge. The bottom wall of the cartridge may define one or more openings to form the one or more outlets of the cartridge.

The one or more openings formed by the tray, together with the openings present in the cartridge prior to piercing by the piercing element of the tray, if any, may form one or more inlets and outlets that are sized and shaped to provide a suitable resistance to draw (RTD) through the cartridge. In some examples, the RTD through the cartridge, from the inlet or inlets to the outlet or outlets, may be from about 10 mm $H_2O$ to about 50 mm $H_2O$, preferably from about 20 mm $H_2O$ to about 40 mm $H_2O$. The RTD of a specimen refers to the static pressure difference between the two ends of the specimen when it is traversed by an air flow under steady conditions in which the volumetric flow is 17.5 milliliters per second at the output end. The RTD of a specimen may be measured using the method set out in ISO Standard 6565:2002.

The one or more openings on the body may cover 5% or greater, 10% or greater, 15% or greater, 20% or greater, or 25% or greater of the area of the wall the openings are on. For example, if the openings are on the top wall, the openings may cover at least 5% of the area of the top wall. The one or more openings on the body may cover 75% or less, 50% or less, 40% or less, or 30% or less of the area of the wall the openings are on.

If the cartridge includes any openings or ventilation holes prior to being pierced with the piercing element of the shisha device, the cartridge may further include a seal or layer covering the openings or ventilation holes prior to use. The seal is preferably sufficient to prevent air flow through the openings or ventilation holes to prevent leakage of the contents of the cartridge and to extend shelf life. The seal may comprise a peelable label of sticker, foil, or the like. The label, sticker, or foil may be affixed to the cartridge in any suitable manner, such as with an adhesive, crimping, welding, or otherwise being joined to the container. The seal may comprise a tab that may be grasped to peel or remove the label, sticker, or foil from the cartridge.

The tray is configured to receive the cartridge and is configured to be received by the shisha device. The tray comprises a body defining a cavity for receiving the cartridge. The cavity of the tray has an open top end into which the cartridge is insertable. The tray has a bottom end. The bottom end may comprise one or more openings allow air that flows through the cartridge to exit the bottom end. The tray includes a piercing element that extends into the cavity from the bottom end. The piercing element is configured to pierce the cartridge when the cartridge is place into the tray and force is applied to the cartridge to cause the first surface of the cartridge to move towards the bottom end of the cavity. The piercing element may comprise one or more elongate elements. The one or more elongate elements are configured to pierce the cartridge. The one or more elongate elements may be hollow. The one or more elongate elements may be in communication with the openings at the bottom end of the cavity such that air flowing through the cartridge may flow through the hollow elongate elements and out the bottom end of the tray.

The body of the cartridge preferably comprises a sidewall that forms an interior surface of the cavity. At least a portion of the interior surface of the cavity may be configured to contact an exterior surface of the cartridge when the cartridge is received in the cavity of the tray. The shape of the portion of the interior surface formed by the sidewall that contacts the cartridge is preferably substantially the same as a shape of an exterior surface of the cartridge. In some embodiments, the shape of the portion of the interior surface formed by the sidewall is shaped to contact a cylindrical cartridge or frustoconical cartridge.

Preferably, at least a portion of the sidewall inwardly tapers in a direction from the open top end of the cavity to the bottom end of the cavity. Such a tapered configuration may prevent insertion of the cartridge into the cavity beyond an intended location, which may facilitate reliable formation of openings in the cartridge by the piercing element as discussed in more detail below. The tapered configuration may also ensure proper seating of the cartridge in the tray. In some embodiments, the cartridge has a frustoconical shape and sidewall is configured to contact the cartridge along a length of the cartridge.

The sidewall of the tray preferably comprises thermally conductive material. Examples of thermally conductive materials that may form the sidewall of the tray include aluminum, copper, zinc, nickel, silver, any alloys thereof, and combinations thereof. Preferably, the sidewall of the tray comprises aluminum.

The sidewall of the tray may have any suitable thickness. If less thermally conductive material is used to form the sidewall, the thickness of the sidewall by be reduced because thinner structures may transfer heat more efficiently than thicker structures.

At least a portion of the surface of the sidewall opposing the interior surface configured to receive the cartridge, which opposing surface will be referred to herein as the exterior surface of the sidewall for purposes of convenience, preferably is configured to contact an interior surface of a receptacle of the shisha device, of which at least a portion is preferably formed by a heating element, when the tray is received by the shisha device. The shape of the portion of the exterior surface formed by the sidewall that contacts the receptacle of the shisha device is preferably substantially the same as a shape of an interior surface of the receptacle. In some embodiments, the shape of the portion of the exterior surface formed by the sidewall is cylindrical or frustoconical.

The tray may comprise a handle extending from the body away from the cavity. The handle may be formed from any suitable material or combination of materials. Preferably, the handle comprises thermally insulating material. Examples of thermally insulating materials that may form the handle of the tray include fiberglass, polyurethane, polystyrene, silica aerogel, or combinations thereof.

The tray may comprise an exterior wall such that a second cavity is formed between the exterior wall and the sidewall that forms the interior surface of the cavity. The second cavity is preferably configured to receive a portion of the shisha device so that the tray may be placed about a portion of the shisha device. Preferably, the exterior wall is thermally insulated from the sidewall such that heat from the sidewall resulting from, for example, contact with a heating element of the shisha device is not substantially transferred to the exterior wall.

The exterior wall may be formed from any suitable material or combination of materials. Preferably, the exterior wall comprises thermally insulating material. Examples of thermally insulating materials that may form the exterior wall of the tray include fiberglass, polyurethane, polystyrene, silica aerogel, or combinations thereof.

The tray may comprise any suitable piercing element extending from the bottom end into the cavity configured to receive the cartridge. Preferably, the piercing element comprises one or more elongate elements. The one or more elongate elements are configured to pierce the cartridge. The one or more elongate elements may comprise tapered ends. The one or more elongate elements may be configured to pierce the cartridge. The one or more elongate elements may be hollow. The one or more elongate elements may be hollow and may be configured to pierce the cartridge to allow air to flow through the hollow portion of the elongate elements. Preferably, the hollow elongate elements provide for suitable openings to be formed to provide a suitable RTD through the cartridge, such as an RTD discussed above. By having the sidewall of the cartridge inwardly tapered from the open top end of the cavity towards the bottom end of the cavity, the distance that the cartridge is inserted into the cartridge may be controlled so that the openings formed in the cartridge formed by the piercing element may be controlled. That is, the tapered sidewall may prevent insertion of the cartridge into the tray beyond an intended location, which will reliably ensure that the distance that the one or more elongate elements of the piercing element extend into the cartridge is substantially the same for each cartridge inserted in the tray over time, provided that the each cartridge has substantially the same size and shape.

The tray may comprise a cap for covering the open top end of the cavity defined by the body of the tray. The cap may comprise a cap piercing element that extends from a surface of the cap configured to face the cavity when the cap covers the open top end of the cavity. The cap piercing element extends into the cavity and is positioned to pierce the cartridge at a top surface when the cartridge is inserted into the cavity and force is applied to the cap to cause the cap piercing element to move towards the bottom end of the cavity. The cap piercing element preferably comprises one or more elongate elements. The one or more elongate elements are configured to pierce the cartridge. The one or more elongate elements may comprise tapered ends. The one or more elongate elements may be configured to pierce the cartridge. The one or more elongate elements may be hollow. The one or more elongate elements may be hollow and may allow air to flow through the hollow portion of the elongate elements. Preferably, the hollow elongate elements provide for suitable openings to be formed to provide a suitable RTD through the cartridge, such as an RTD discussed above.

The tray may be used with any suitable cartridge and any suitable shisha device. Preferably, the shisha device is configured to sufficiently heat the aerosol-forming substrate in the cartridge when disposed in the tray to volatilize one or more constituents of the aerosol-forming substrate to form an aerosol but not to combust the aerosol-forming substrate. For example, the shisha device may be configured to heat the aerosol-forming substrate to a temperature in a range from about 150° C. to about 300° C.; more preferably from about 180° C. to about 250° C. or from about 200° C. to about 230° C.

The shisha device may include a receptacle for receiving the cartridge and tray. The shisha device may include a heating element configured to contact or to be in proximity to the body of the cartridge when the cartridge and tray are received in the receptacle. The heating element may form at least part of the receptacle. For example, the heating element may form at least a portion of the surface of the receptacle. The shisha cartridge may be configured to transfer heat from the heating element to the aerosol-forming substrate in the cavity by conduction. In some embodiments, the heating element includes an electric heating element. In some embodiments, the heating element includes a resistive heating component. For example, the heating element may include one or more resistive wires or other resistive elements. The resistive wires may be in contact with a thermally conductive material to distribute heat produced over a broader area. Examples of suitable conductive materials include aluminum, copper, zinc, nickel, silver, and combinations thereof. The heating element may form at least a portion of the surface of the receptacle.

Preferably, at least a portion of the receptacle inwardly tapers in a direction that the tray is configured to be inserted into the receptacle. In some embodiments, the exterior surface of the sidewall of the tray has a frustoconical shape and the receptacle is configured to contact the sidewall along a length of the sidewall of the tray.

The shisha device may include control electronics operably coupled to the heating element. The control electronics may be configured to control heating of the heating element. The control electronics may be configured to control the temperature to which the aerosol-forming substrate in the cartridge is heated. The control electronics may be provided in any suitable form and may, for example, include a controller or a memory and a controller. The controller may include one or more of an Application Specific Integrated Circuit (ASIC) state machine, a digital signal processor, a gate array, a microprocessor, or equivalent discrete or integrated logic circuitry. Control electronics may include memory that contains instructions that cause one or more components of the circuitry to carry out a function or aspect of the control electronics. Functions attributable to control electronics in this disclosure may be embodied as one or more of software, firmware, and hardware.

The electronic circuitry may include a microprocessor, which may be a programmable microprocessor. The electronic circuitry may be configured to regulate a supply of power. The power may be supplied to the heater element in the form of pulses of electrical current.

In some examples, the control electronics may be configured to monitor the electrical resistance of the heating element and to control the supply of power to the heating element depending on the electrical resistance of the heating element. In this manner, the control electronics may regulate the temperature of the resistive element.

The shisha device may include a temperature sensor, such as a thermocouple. The temperature sensor may be operably coupled to the control electronics to control the temperature of the heating element. The temperature sensor may be positioned in any suitable location. For example, the temperature sensor may be configured to insert into the cartridge when received within the receptacle to monitor the temperature of the aerosol-forming substrate being heated. In addition or alternatively, the temperature sensor may be in contact with the heating element. In addition or alternatively, the temperature sensor may be positioned to detect temperature at an aerosol outlet of the shisha device or a portion thereof. The sensor may transmit signals regarding the sensed temperature to the control electronics. The control electronics may adjust heating of the heating elements in response to the signal to achieve a suitable temperature at the sensor.

The control electronics may be operably coupled to a power supply. The shisha device may include any suitable power supply. For example, a power supply of a shisha device may be a battery or set of batteries. The batteries of the power supply may be rechargeable, removable and replaceable, or rechargeable and removable and replaceable. Any suitable battery may be used. For example, heavy duty type or standard batteries existing in the market, such as used for industrial heavy-duty electrical power-tools. Alternatively, the power supply may be any type of electric power supply including a super or hyper-capacitor. Alternatively, the assembly may be connected to an external electrical power source, and electrically and electronically designed for such purpose. Regardless of the type of power supply employed, the power supply preferably provides sufficient energy for the normal functioning of the assembly for at least one shisha session until aerosol is depleted from the aerosol-forming substrate in the cartridge before being recharged or needing to connect to an external electrical power source. Preferably, the power supply provides sufficient energy for the normal functioning of the assembly for at least about 70 minutes of continuous operation of the device, before being recharged or needing to connect to an external electrical power source.

In one example, a shisha device includes an aerosol-generating element that includes a receptacle, a heating element, an aerosol outlet, and an air inlet. The receptacle is configured to receive a tray in which a cartridge comprising the aerosol-forming substrate is disposed. The heating element may define at least part of a surface of the receptacle.

The shisha device includes an air inlet in fluid connection with the receptacle. In use, when the substrate inside the cartridge is heated, aerosol former components in the substrate vaporize. Air flowing from the air inlet through the cartridge becomes entrained with aerosol generated from the aerosol former components in the cartridge.

Some electrically heated shisha devices employ preheated air and typically employ an airflow path such that the air travels in the vicinity of the heat source upon puffing. Further, some electrically heated shisha devices employ elements that increase radiation heat transfer by increasing the heated surface area.

The air inlet may be in communication with a channel that may include one or more apertures through the cartridge receptacle such that air from outside the shisha device may flow through the channel and into the cartridge receptacle through the one or more apertures. If a channel includes more than one aperture, the channel may include a manifold to direct air flowing through the channel to each aperture. Preferably, the shisha device includes two or more air inlet channels.

As described above, the cartridge includes one or more openings (such as inlets or outlets) formed in the body, allowing air to flow through the cartridge. If the receptacle includes one or more inlet apertures, at least some of the inlets in the cartridge may align with the apertures in the top of the receptacle. The cartridge may include an alignment feature configured to mate with a complementary alignment feature of the tray, and the tray may comprise an alignment feature configured to mate with a complementary alignment feature of the receptacle to align the inlets of the cartridge with the apertures of the receptacle when the cartridge is inserted into the receptacle.

Air that enters the cartridge may flow across or through, or both across and through the aerosol-forming substrate, entraining aerosol, and exiting the cartridge and receptacle via an aerosol outlet. From the aerosol outlet, the air carrying the aerosol enters a vessel of the shisha device.

The shisha device may include any suitable vessel defining an interior volume configured to contain a liquid and defining an outlet in the headspace above a liquid fill level. The vessel may include an optically transparent or opaque housing to allow a consumer to observe contents contained in the vessel. The vessel may include a liquid fill demarcation, such as a liquid fill line. The vessel may be formed of any suitable material. For example, the vessel may include glass or suitable rigid plastic material. Preferably, the vessel is removable from a portion of the shisha assembly comprising the aerosol-generation element to allow a consumer to fill, empty or clean the vessel.

The vessel may be filled to a liquid fill level by a consumer. The liquid preferably includes water, which may optionally be infused with one or more colorants, flavorants, or colorants and flavorants. For example, the water may be infused with one or both of botanical and herbal infusions.

Aerosol entrained in air exiting the aerosol outlet of the receptacle may travel through a conduit positioned in the vessel. The conduit may be coupled to the aerosol outlet of the aerosol-generating element and may have an opening below the liquid fill level of the vessel, such that aerosol flowing through the vessel flows through the opening of the conduit, then through the liquid, into headspace of the vessel and exits through a headspace outlet, for delivery to a consumer.

The headspace outlet may be coupled to a hose comprising a mouthpiece for delivering the aerosol to a consumer. The mouthpiece may include an activation element, such as a switch activatable by a user, a puff sensor arranged to detect a user puffing on the mouthpiece, or both a switch activatable by the user and a puff sensor. The activation element is operably coupled to the control electronics of the shisha device. The activation element may be wirelessly coupled to the control electronics. Activation of the activation element may cause the control electronics to activate the heating element, rather than constantly supplying energy to the heating element. Accordingly, the use of an activation element may serve to save energy relative to devices not employing such elements to provide on-demand heating rather than constant heating.

For purposes of example, one method for using a shisha device as described herein is provided below in chronological order. The vessel may be detached from other components of the shisha device and filled with water. One or more of natural fruit juices, botanicals, and herbal infusions may be added to the water for flavoring. The amount of liquid added should cover a portion of the conduit but should not exceed a fill level mark that may optionally exist on the vessel. The vessel is then reassembled to the shisha device.

The cartridge may be placed in the tray and the cap may be placed on the tray with application of suitable force to cause upper and lower piercing elements of the tray to form openings in the cartridge. The tray and cartridge may be placed in the receptacle of the shisha device. Alternatively, the tray may be placed in the receptacle of the shisha device, the cartridge may be placed in the tray, and the cap may be placed on the tray.

The device may then be turned on. Turning on the device may initiate a heating profile of a heating element, to heat the aerosol-forming substrate to a temperature at or above a vaporization temperature but below a combustion temperature of the aerosol-forming substrate. The aerosol forming compounds of the aerosol-forming substrate vaporize, generating an aerosol. The user may puff on the mouthpiece as desired. The user may continue using the device as long as desired or until no more aerosol is visible or being delivered. In some embodiments, the device may be arranged to automatically shut off when the cartridge or a compartment of the cartridge is depleted of usable aerosol-forming substrate. The shisha device may be turned off at any time by a consumer by, for example, switching off the device.

The shisha device may have any suitable air management. In one example, puffing action from the user will create a suction effect causing a low pressure inside the device which will cause external air to flow through an air inlet of the device, into the air inlet channel, and into the receptacle. The air may then flow through the cartridge in the receptacle and become entrained with aerosol produced from the aerosol-forming substrate. The air with entrained aerosol then exits the aerosol outlet of the receptacle, flows through the conduit to the liquid inside the vessel. The aerosol will then bubble out of the liquid and into head space in the vessel above the level of the liquid, out the headspace outlet, and through the hose and mouthpiece for delivery to the consumer. The flow of external air and the flow of the aerosol inside the shisha device may be driven by the action of puffing from the user.

When the aerosol-forming substrate in the cartridge is depleted or the shisha experience has ended, the user may remove the tray from the receptacle, may remove the lid from the tray, and may invert the tray to empty the cartridge into a suitable waste container.

Reference will now be made to the drawings, which depict one or more embodiments described in this disclosure. However, it will be understood that other embodiments not depicted in the drawings fall within the scope and spirit of this disclosure. Like numbers used in the figures refer to like components. The use of different numbers to refer to components in different figures is not intended to indicate that the different numbered components cannot be the same or similar to other numbered components. The figures are presented for purposes of illustration and not limitation. Schematic drawings presented in the figures are not necessarily to scale.

FIG. 1 is a schematic view of an embodiment of a shisha device. Because interaction of a tray, cartridge, and shisha device are shown in more detail in FIGS. 2-5, the tray is omitted from FIG. 1 for convenience.

FIGS. 2A, 2B, and 2C are schematic perspective views of a portion of an embodiment of a shisha device and associated tray and cartridge.

Figure 1:
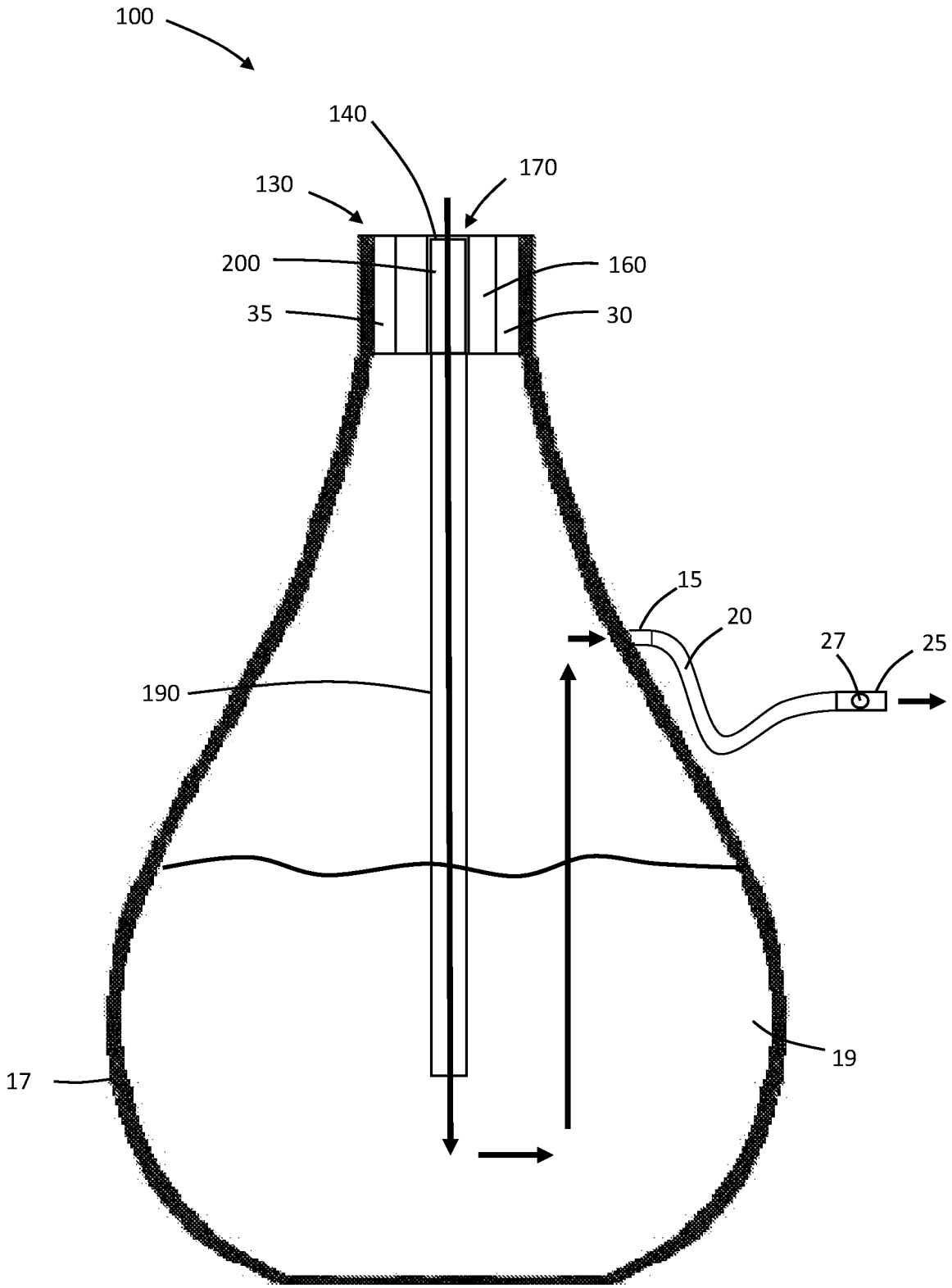

FIG. 1 is a schematic sectional view of an example of a shisha device 100. The device 100 includes a vessel 17 defining an interior volume configured to contain liquid 19 and defining a headspace outlet 15 above a fill level for the liquid 19. The liquid 19 preferably includes water, which may optionally be infused with one or more colorants, one or more flavorants, or one or more colorants and one or more flavorants. For example, the water may be infused with one or both of botanical infusions and herbal infusions.

The device 100 also includes an aerosol-generating element 130. The aerosol-generating element 130 includes a receptacle 140 configured to receive a tray (not shown) and cartridge 200 comprising an aerosol-forming substrate. The aerosol-generating element 130 may also include a heating element 160. The heating element 160 may form at least one surface of the receptacle 140. In the depicted embodiment, the heating element 160 defines the side surfaces of the receptacle 140. The aerosol-generating element 130 also includes an air inlet 170 that draws air into the device 100. The air enters the cartridge 200, which is also heated by heating element 160, to carry aerosol generated by the aerosol former and the aerosol-forming substrate. The air exits an outlet of the aerosol-generating element 130 and enters a conduit 190.

The conduit 190 carries the air and aerosol into the vessel 17 below the level of the liquid 19. The air and aerosol may bubble through the liquid 19 and exit the headspace outlet 15 of the vessel 17. A hose 20 may be attached to the headspace outlet 15 to carry the aerosol to the mouth of a user. A mouthpiece 25 may be attached to, or form a part of, the hose 20.

An illustrative air flow path of the device, in use, is depicted by arrows in FIG. 1.

The mouthpiece 25 may include an activation element 27. The activation element 27 may be a switch, button or the like, or may be a puff sensor or the like. The activation element 27 may be placed at any other suitable location of the device 100. The activation element 27 may be in wireless communication with the control electronics 30 to place the device 100 in condition for use or to cause control electronics to activate the heating element 160; for example, by causing power supply 35 to energize the heating element 160.

The control electronics 30 and power supply 35 may be located in any suitable position of the aerosol-generating element 130, including locations other than the sides of the element 130 as depicted in FIG. 1.

Figure 2A:
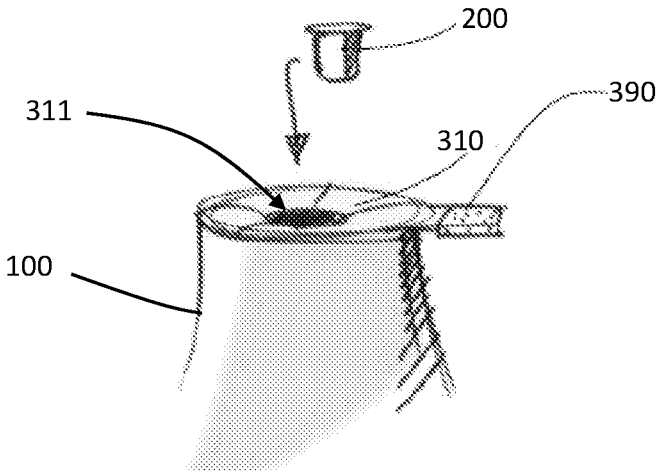
Figure 2B:
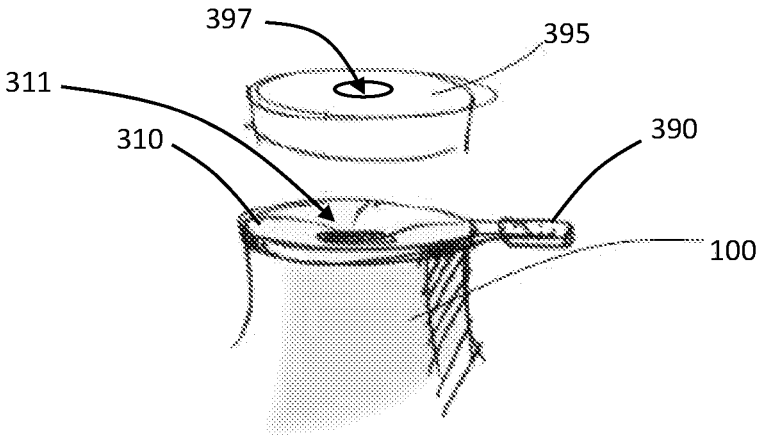
Figure 2C:
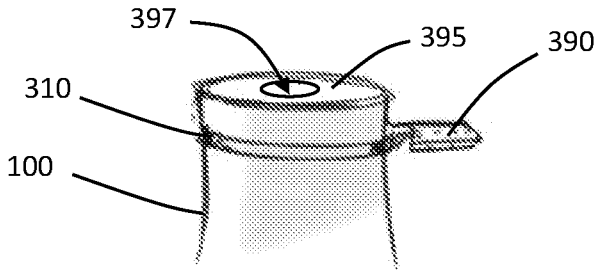

Referring now to FIGS. 2A, 2B, and 2C, a body 310 of a tray is inserted into a receptacle of a shisha device 100. The body 310 of the tray defines a cavity 311 configured to receive a cartridge 200 comprising an aerosol-forming substrate. When cartridge 200 is inserted into the cavity 311 and the body 310 is inserted in the receptacle of the shisha device 100, the cartridge 200 may be heated by the shisha device to volatilize one or more constituents of the aerosol-forming substrate for inhalation by a user. The tray also comprises a cap 395 for covering an open top end of the cavity formed by the body 310 of the tray. The cap 395 includes a through hole 397 to allow air to enter the shisha device and flow through the cartridge 200. The tray depicted in FIG. 1 includes a handle 390 extending from the body 310 away from the cavity. The handle 390 may be grasped by a user to facilitate manipulation of the tray and cartridge 200. The handle 390 may comprise thermally insulating material to prevent a substantial amount of heat generated though use of the shisha device 100 from reaching the handle 390.

Figure 3:
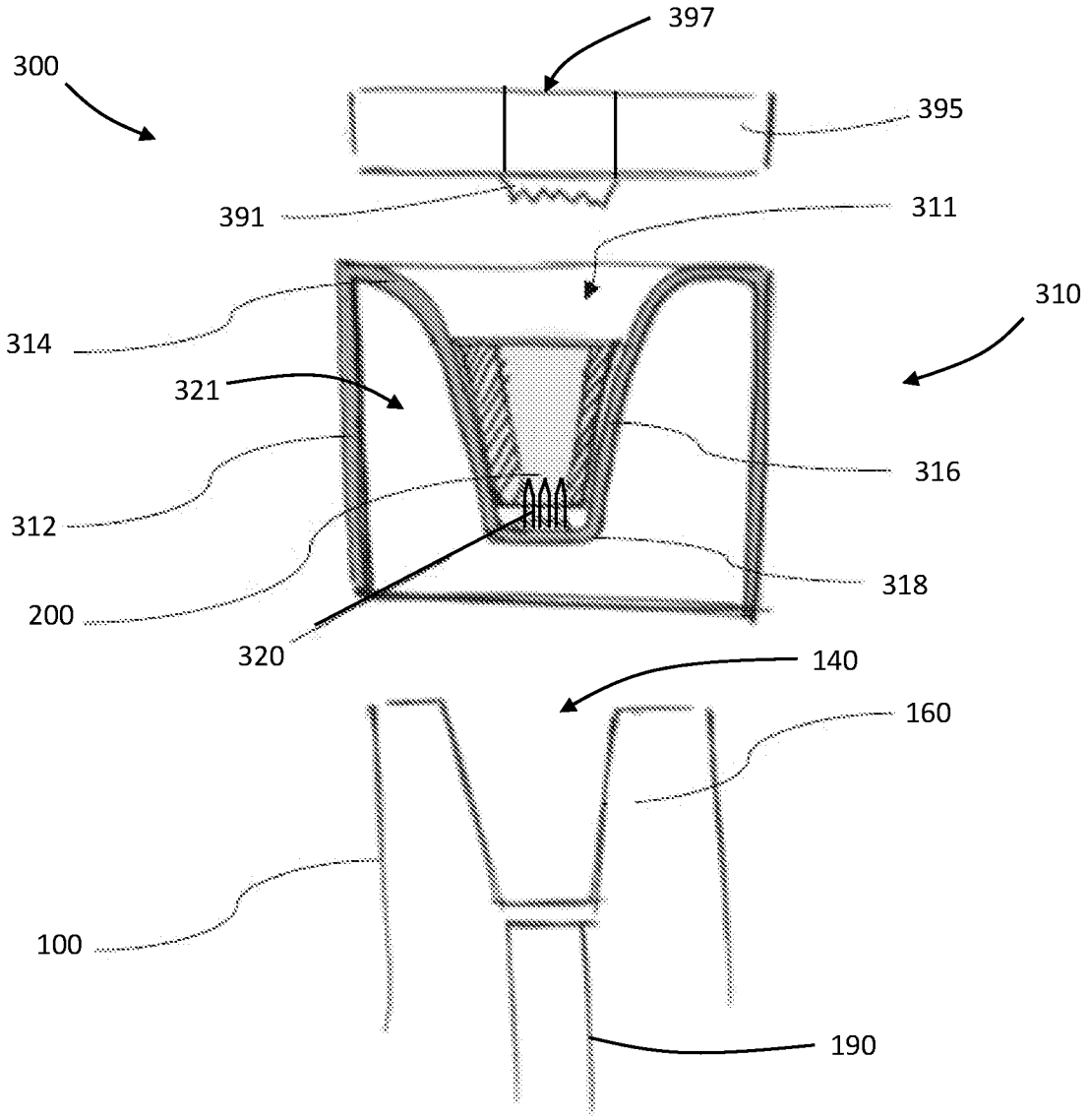
FIG. 3 is a schematic sectional view a portion of an embodiment of a shisha device and associated tray and cartridge.

FIG. 3 shows a tray 300 that includes a body 310 and a cap 395. The body 310 is a single piece having a sidewall 316 that defines a cavity 311 that extends from an open top end to a bottom end 318. The body 310 also has an exterior wall 312 that extends from a top shoulder 314 of the cavity 311. The exterior wall 312 defines a second cavity 321 between the exterior wall 312 and the sidewall 316. The second cavity is configured to receive a top portion of the shisha device 100 such that at least a portion of the exterior wall 312 of the body 310 of the tray is disposed about the shisha device 100 when the sidewall 316 of the tray 300 is received in the receptacle 140 of the shisha device 100.

The exterior wall 312 of the body 310 of the tray 300 holds the body 310 in position relative to the shisha device 100. The exterior wall 312 may be formed from a thermally insulating material or materials to allow a user to grasp the exterior wall 312 following use of the shisha device 100 without causing the user discomfort due to heat generated during use of the device 100.

The cavity 311 provides a space for receiving a cartridge 200 comprising aerosol-forming substrate. The sidewall 316 defining the cavity 311 is configured to contact the cartridge 200 along the length of the cartridge 200 to transfer heat from the heating element 160 that forms at least a portion of the receptacle 140 of the shisha device 100 to the cartridge 200. The top shoulder 314 facilitates positioning of the cartridge 200 in the cavity 311 and guides the cartridge 200 into its operation position during insertion.

The body 310 includes a bottom piercing element 320. The piercing element comprises a plurality of hollow elongate elements having tapered ends that pierce the cartridge 200 to form outlets in the cartridge 200 for air flow through the cartridge and into conduit 190.

The cap 395 includes a through hole 397 in communication with hollow elongate elements that form upper piercing element 391 of the tray 300. When the cap 395 is inserted into the open top end of the cavity 311, the hollow elongate elements of the piercing element 391 pierce the cartridge 200 to form inlets for air flow through the cartridge 200. The cap 395 may be pressed into place in the cavity 311. In some embodiments (not shown), the cap may be screwed into the cavity via suitable threaded engagement.

Figure 4:
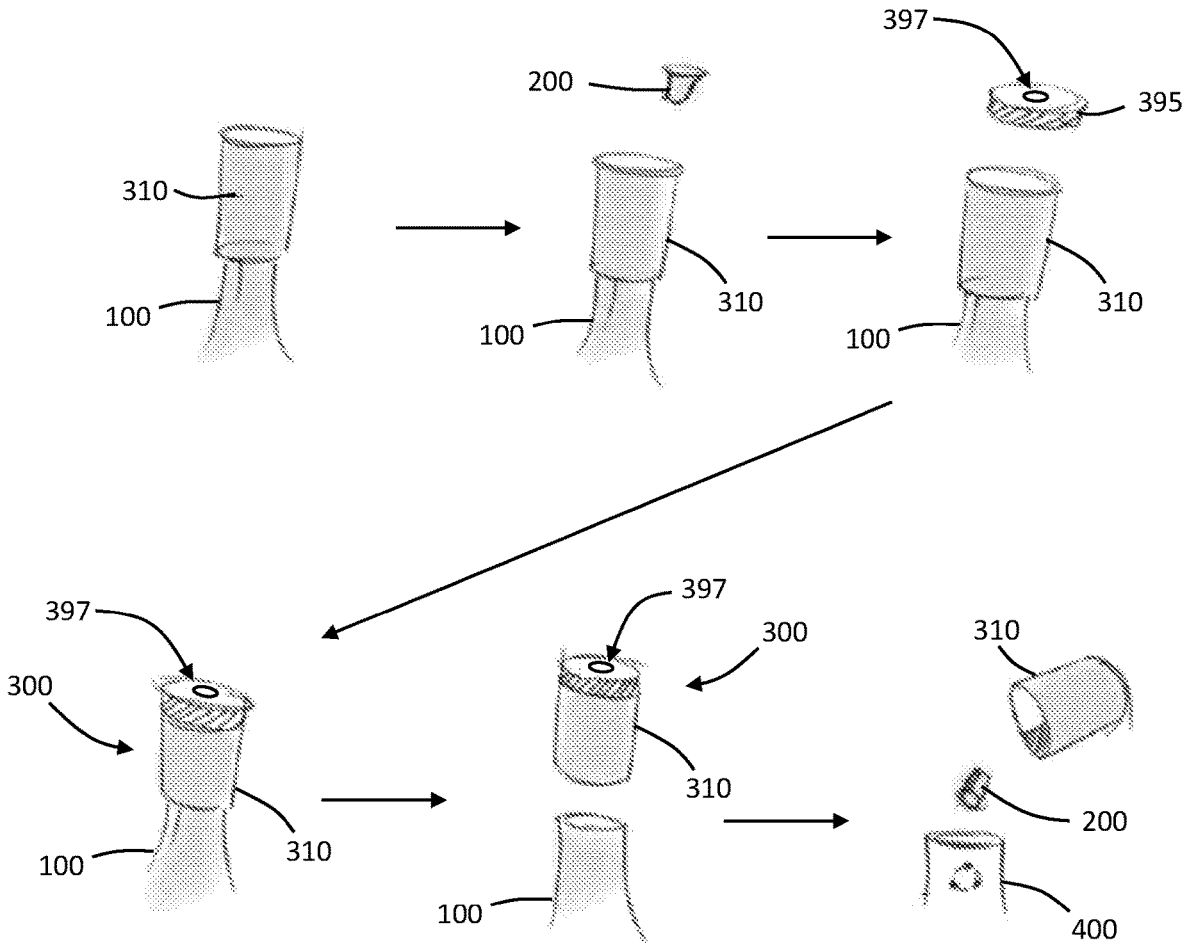
FIG. 4 is a series of schematic perspective views illustrating use of an embodiment of a shisha device and associated tray and cartridge.

Referring now to FIG. 4, an overview of a process for using a tray 300 that includes a body having an exterior wall is shown. The body 310 of the tray 300 may be placed on the shisha device 100 such that the exterior wall is disposed about a portion of the shisha device and the sidewall 316 is received in the receptacle of the shisha device. A cartridge 200 may be placed in the cavity formed by the body 310 of the tray 300, and a cap 395 having a through hole 397 may be placed on the body 310. Placing the cap 395 on the body 310 may pierce the top and bottom of the cartridge 200 to form inlets and outlets for air flow through the cartridge 200. Once the aerosol-forming substrate of the cartridge 200 is depleted or the shisha session has ended, the tray 300 may be removed from the shisha device 100, the cap 395 may be removed from the body 310 of the tray 300, and the body 310 may be inverted to cause the cartridge 200 to be disposed in an appropriate waste container 400.

Figure 5:
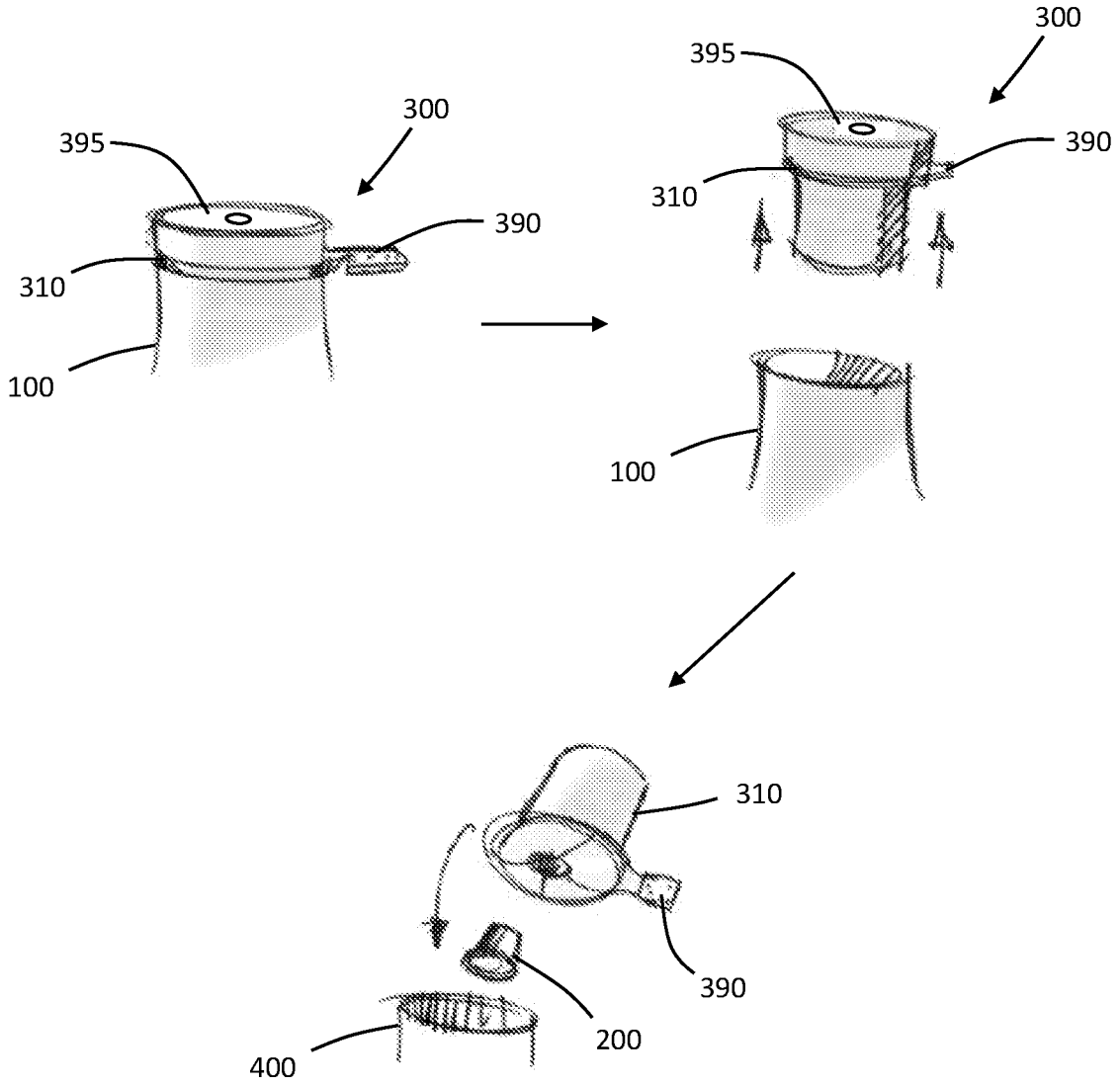
FIG. 5 is a series of schematic perspective views illustrating use of an embodiment of a shisha device and associated tray and cartridge.

FIG. 5 provides an overview of a process for using a tray 300 having a body 310 that does not include an exterior wall. The body 310 includes sidewalls that form a cavity for receiving a cartridge 200 and for being received in a receptacle of a shisha device 100. The body 310 includes a handle 390. When the aerosol-forming substrate of the cartridge 200 is depleted or the shisha session has ended, the tray 300 may be removed from the shisha device 100 by grasping the handle 390, the cap 395 may be removed from the body 310 of the tray 300, and the body 310 may be inverted to cause the cartridge 200 to be disposed in an appropriate waste container 400.

Thus, trays with piercing elements for use with shisha devices are described. Various modifications and variations of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are apparent to those skilled in the mechanical arts, chemical arts, and aerosol-generating article manufacturing or related fields are intended to be within the scope of the following claims.

The invention claimed is:

1. An assembly comprising:

a shisha device comprising a receptacle and a heating element forming at least a part of the receptacle; and a tray for use with the shisha device, the tray being removably coupled to the receptacle and comprising:

a body defining an upper cavity for receiving a cartridge comprising an aerosol-forming substrate, the upper cavity having an open top end into which the cartridge is insertable and having a bottom end, and a lower cavity configured for receiving the receptacle so that the receptacle substantially surrounds the cartridge received in the upper cavity, and the heating element is positioned to heat the cartridge, wherein the body comprises a sidewall that forms an interior surface of the upper cavity and an exterior wall, wherein the lower cavity is formed between the exterior wall and the sidewall;

a bottom piercing element extending into the upper cavity from the bottom end of the upper cavity; and a handle extending from the body away from the upper cavity; and a cap removably coupled to open top end of the body, the cap comprising a through hole, wherein the bottom piercing element is positioned to pierce the cartridge at a first surface when the cartridge is inserted into the upper cavity of the tray and force is applied to the cartridge via the cap to cause the first surface of the cartridge to move towards the bottom end of the upper cavity.

2. The assembly according to claim 1, wherein the sidewall is formed from a thermally conductive material.

3. The assembly according to claim 2, wherein at least a portion of the sidewall inwardly tapers in a direction from the open top end of the upper cavity to the bottom end of the upper cavity.

4. The assembly according to claim 3, wherein the upper cavity is frustoconical.

5. The assembly according to claim 1, wherein the handle is formed from thermally insulating material.

6. The assembly according to claim 1, wherein the exterior wall is thermally insulated from the sidewall.

7. The assembly according to claim 1, wherein the cap comprises a cap piercing element extending from a surface configured to face the upper cavity when the cap covers the open top end of the upper cavity, and wherein the cap piercing element extends into the upper cavity and is positioned to pierce the cartridge at a second surface when the cartridge is inserted in the upper cavity of the tray and force is applied to the cap to cause the cap piercing element to move towards the bottom end of the upper cavity.

8. The assembly according to claim 1, further comprising the shisha device.

9. The assembly according to claim 8, wherein the shisha device further comprises:

a vessel comprising an interior volume configured to house a liquid;

a receptacle for receiving the tray;

a heating element that defines at least a portion of a surface of the receptacle, the heating element being configured to heat aerosol-forming substrate within a cartridge received in the tray to produce aerosol; and a conduit for carrying the aerosol from the cartridge to the vessel.

10. The assembly according to claim 1, wherein the aerosol-forming substrate in the cartridge comprises nicotine.

11. The assembly according to claim 1, wherein the aerosol-forming substrate contained in the cartridge comprises tobacco.

12. A system comprising:

a shisha device comprising:

a vessel comprising a vessel sidewall and an interior volume configured to house a liquid;

a receptacle formed by the vessel sidewall;

a heating element that forms at least a part of the receptacle, the heating element being configured to heat aerosol-forming substrate within a cartridge to produce aerosol; and a conduit for carrying the aerosol from the cartridge to the vessel; and a tray for use with the shisha device and configured to be removably coupled to the receptacle, the tray comprising:

a body defining an upper cavity for receiving the cartridge comprising an aerosol-forming substrate, the upper cavity having an open top end into which the cartridge is insertable and having a bottom end, and a lower cavity configured for receiving the receptacle so that the receptacle substantially surrounds the cartridge received in the upper cavity, and the heating element is positioned to heat the cartridge, wherein the body comprises a sidewall that forms an interior surface of the upper cavity and an exterior wall, wherein the lower cavity is formed between the exterior wall and the sidewall;

a bottom piercing element extending into the upper cavity from the bottom end of the upper cavity; and a handle extending from the body away from the upper cavity; and a cap removably coupled to open top end of the tray body, the cap comprising a through hole, wherein the bottom piercing element is positioned to pierce the cartridge at a first surface when the cartridge is inserted into the upper cavity of the tray and force is applied to the cartridge via the cap to cause the first surface of the cartridge to move towards the bottom end of the upper cavity.

13. The system of claim 12, wherein at least a portion of the sidewall inwardly tapers in a direction from the open top end of the upper cavity to the bottom end of the upper cavity.

14. The system of claim 12, comprising a cap for covering the open top end of the upper cavity defined by the body, wherein the cap comprises a cap piercing element extending from a surface configured to face the upper cavity when the cap covers the open top end of the upper cavity, and wherein the cap piercing element extends into the upper cavity and is positioned to pierce the cartridge at a second surface when the cartridge is inserted in the upper cavity of the tray and force is applied to the cap to cause the cap piercing element to move towards the bottom end of the upper cavity.

15. The system of claim 12 further comprising the cartridge, wherein the cartridge contains aerosol-forming substrate comprising tobacco.

16. The assembly according to claim 1, wherein the cartridge and the sidewall of the tray are frustoconical, and the sidewall of the tray is configured to contact the cartridge along a length of the cartridge.

17. The assembly according to claim 1, wherein a portion of an exterior surface formed by the lower cavity that contacts the receptacle has substantially the same as a shape as the shape of an interior surface of the receptacle, and the interior surface of the receptacle is configured to contact the lower cavity along a length of the lower cavity.

18. The assembly according to claim 1, wherein the body is a single piece.

19. The assembly according to claim 1, wherein the cartridge and the upper cavity are frustoconical, and the upper cavity is configured to contact the cartridge along a length of the cartridge, wherein a portion of an exterior surface formed by the lower cavity that contacts the receptacle has substantially the same as a shape as the shape of an interior surface of the receptacle, and the interior surface of the receptacle is configured to contact the lower cavity along a length of the lower cavity, and wherein the body is a single piece.

20. The assembly according to claim 1, wherein the cartridge, the upper cavity, and the receptacle are shaped and sized in a fit to minimize distance from the heating element to the cartridge.

* * * * *